US011810743B2

(12) United States Patent
Hazawa et al.

(10) Patent No.: US 11,810,743 B2
(45) Date of Patent: Nov. 7, 2023

(54) MECHANICAL LATCHING DEVICE OF ELECTROMAGNETIC CONTACTOR

(71) Applicant: FUJI ELECTRIC FA COMPONENTS & SYSTEMS CO., LTD., Konosu (JP)

(72) Inventors: Koumei Hazawa, Kounosu (JP); Ryotaro Ninagawa, Kounosu (JP)

(73) Assignee: FUJI ELECTRIC FA COMPONENTS & SYSTEMS CO., LTD., Saitama (JP)

( * ) Notice: Subject to any disclaimer, the term of this patent is extended or adjusted under 35 U.S.C. 154(b) by 0 days.

(21) Appl. No.: 17/826,383

(22) Filed: May 27, 2022

(65) Prior Publication Data

US 2023/0005690 A1 Jan. 5, 2023

(30) Foreign Application Priority Data

Jul. 5, 2021 (JP) ..... 2021-111552

(51) Int. Cl.
*H01H 50/32* (2006.01)
*H01H 50/64* (2006.01)
(Continued)

(52) U.S. Cl.
CPC ..... *H01H 50/32* (2013.01); *H01H 50/643* (2013.01); *H01H 51/10* (2013.01); *H01H 50/02* (2013.01)

(58) Field of Classification Search
CPC ..... H01H 51/10; H01H 50/32
(Continued)

(56) References Cited

U.S. PATENT DOCUMENTS 1,455,763 A * 5/1923 Werner ..... H01H 50/32 335/173
2,932,705 A * 4/1960 Nicolaus ..... H01H 51/10 335/189

(Continued)

FOREIGN PATENT DOCUMENTS

DE 19631533 A1 1/1998
JP 2000251601 A 9/2000

OTHER PUBLICATIONS

Extended European Search Report dated Nov. 21, 2022 in related European Patent Application No. 22175004.5 (8 pages) (in English).

*Primary Examiner* — Alexander Talpalatski

(57) ABSTRACT

A mechanical latching device of an electromagnetic contactor eliminates a need to adjust a gap between portions mechanically preventing returning of a latch support. A latch support includes a protrusion protruding laterally and formed with a latch surface facing a released side. A rotating member has one end side rotatably supported and the other end side biased toward the protrusion. When the latch support is on the released side, an outer peripheral surface of the other end side contacts with a tip of the protrusion to allow the latch support to be displaced to a closed side. When the latch support is on the closed side, the other end side rotates according to a position of the latch support in a displacement direction, and a tip surface faces the latch surface to mechanically prevent the latch support from returning to the released side at plural positions along the displacement direction.

12 Claims, 7 Drawing Sheets

(51) Int. Cl.
*H01H 51/10* (2006.01)
*H01H 50/02* (2006.01)

(58) Field of Classification Search
USPC ..... 335/167
See application file for complete search history.

(56) References Cited

U.S. PATENT DOCUMENTS 3,882,435 A * 5/1975 Grass ..... H01H 51/10
335/167
4,710,739 A * 12/1987 Heyne ..... H01H 71/1054
335/170
5,300,906 A * 4/1994 Blanchard ..... H01H 71/32
335/167
6,922,121 B2 * 7/2005 Kim ..... H01F 7/124
335/253

* cited by examiner

MECHANICAL LATCHING DEVICE OF ELECTROMAGNETIC CONTACTOR

CROSS REFERENCE TO RELATED APPLICATIONS AND INCORPORATION BY REFERENCE

This application claims benefit of priority under 35 USC 119 based on Japanese Patent Application No. 2021-111552 filed on Jul. 5, 2021, the entire contents of which are incorporated by reference herein.

TECHNICAL FIELD

The present invention relates to a mechanical latching device of an electromagnetic contactor.

BACKGROUND ART

When it is desired to prevent an electromagnetic contactor from being shut down due to a power failure or a dropped circuit voltage in a circuit or it is desired to suppress power consumption for energization at all times, the electromagnetic contactor is required to be mechanically held in a closed state. Therefore, a mechanical latching device is attached to the electromagnetic contactor. In a mechanical latching device disclosed in PTL 1, when a latch support is displaced to a closed side in conjunction with a contact support, a roller attached to a latch lever is caught on a shoulder portion of the latch support to mechanically prevent the latch support from returning to a released side.

CITATION LIST

Patent Literature

PTL 1: JP 2000-251601 A

SUMMARY OF INVENTION

Technical Problem

When a control coil of the electromagnetic contactor is excited, a slight gap (allowance) is provided between the shoulder portion of the latch support and the roller. However, the amount of stroke of the contact support varies depending on the model of the electromagnetic contactor and individual differences even in the same model, so that the gap also varies in size. When the excitation of the control coil of the electromagnetic contactor is stopped, the latch support returns by the amount of the gap, due to which depending on the size of the gap, there has been a need for gap adjustment work, such as replacement of the roller with one different in outer diameter.

An object of the present invention is to provide a mechanical latching device of an electromagnetic contactor that improves convenience by eliminating the need to adjust a gap between portions that mechanically prevent the returning of a latch support.

Solution to Problem

According to an aspect of the invention there is provided a mechanical latching device of an electromagnetic contactor, the mechanical latching device including: a latch support connected to a contact support of the electromagnetic contactor and displaceable between a released side and a closed side, the latch support including a protrusion protruding laterally and formed with a latch surface facing the released side; and a rotating member having one end side rotatably supported beside the latch support and an other end side biased toward the protrusion, wherein when the latch support is on the released side, an outer peripheral surface of the other end side is in contact with a tip of the protrusion to allow the latch support to be displaced to the closed side, and when the latch support is on the closed side, the other end side rotates according to a position of the latch support in a displacement direction, and a tip surface of the other end side faces the latch surface to mechanically prevent the latch support from returning to the released side at a plurality of positions along the displacement direction.

Advantageous Effects of Invention

According to the present invention, when the latch support is on the closed side, the tip surface of the rotating member faces the latch surface according to the position of the latch support in the displacement direction, thereby mechanically preventing the latch support from returning to the released side at the plurality of positions along the displacement direction. This eliminates the need for work on adjusting the gap between the portions that mechanically prevent the returning of the latch support, so that improved convenience can be achieved.

DESCRIPTION OF EMBODIMENTS

Hereinafter, embodiments of the present invention are described with reference to the drawings. It should be noted that each drawing is schematic and may not be the same as actual one. Additionally, the embodiments given below exemplify devices and methods for embodying the technological concept of the present invention, and do not limit components of the invention to those below. In other words, various modifications can be added to the technological concept of the present invention without departing from the technological scope described in the appended claims.

First Embodiment

Configuration

In the following description, three directions orthogonal to each other are defined as longitudinal direction, widthwise direction, and depthwise direction for convenience. Note that a front side in the depthwise direction corresponds to a released side in a displacement direction, and a back side in the depthwise direction corresponds to a closed side in the displacement direction.

Figure 1:
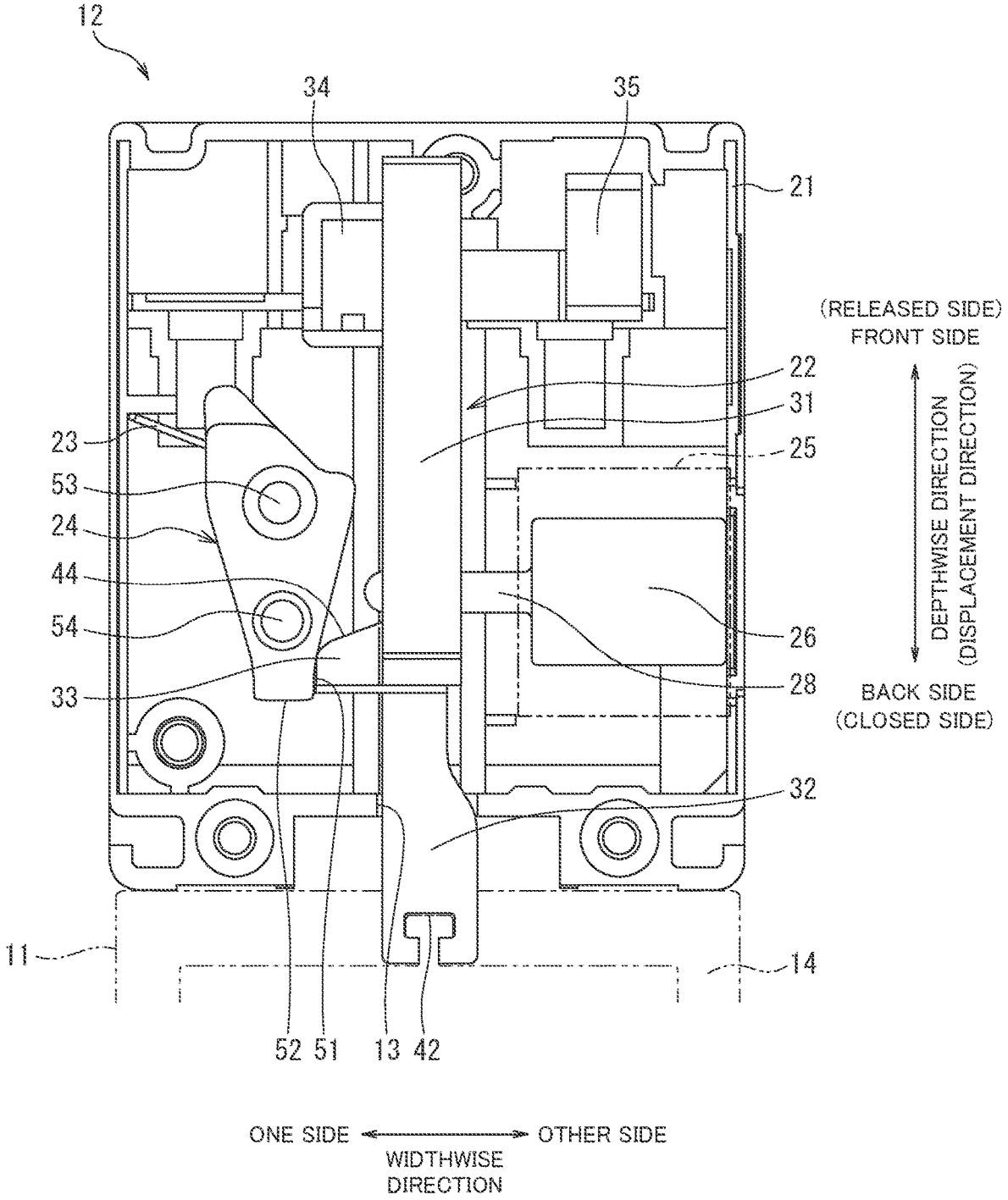
FIG. 1 is a diagram illustrating a mechanical latching device of an electromagnetic contactor.

FIG. 1 is a diagram illustrating a mechanical latching device of an electromagnetic contactor.

When it is desired to prevent an electromagnetic contactor 11 from being shut down due to a power failure or a dropped circuit voltage in a circuit or it is desired to suppress power consumption for energization at all times, the electromagnetic contactor 11 is required to be mechanically kept in an closed state. To do so, a mechanical latching device 12 is attached to the electromagnetic contactor 11. Here, apart of the electromagnetic contactor 11 is virtually indicated by a long dashed double-short dashed line, and a detailed description thereof is omitted.

The following is a description of the mechanical latching device 12. Here is illustrated a structure of the mechanical latching device 12 as viewed from a longitudinal one side thereof, in which no illustration of a contact portion is given for ease of description. The mechanical latching device 12 includes a case 21, a latch support 22, a torsion spring 23, a rotating member 24, an electromagnet 25, and a plunger 26.

The case 21 has a substantially rectangular parallelepiped external shape and is attached on the front side of the depthwise direction in the electromagnetic contactor 11.

The latch support 22 is arranged at substantially a center of the case 21 in the widthwise direction inside the case 21. A portion of the latch support 22 on the back side in the depthwise direction is caused to protrude from an opening portion 13 of the case 21 and connected to a contact support 14 of the electromagnetic contactor 11, thereby allowing the latch support 22 to be displaceable between the released side and the closed side. Here, apart of the contact support 14 is virtually indicated by a long dashed double-short dashed line, and a detailed description thereof is omitted.

Figure 2:
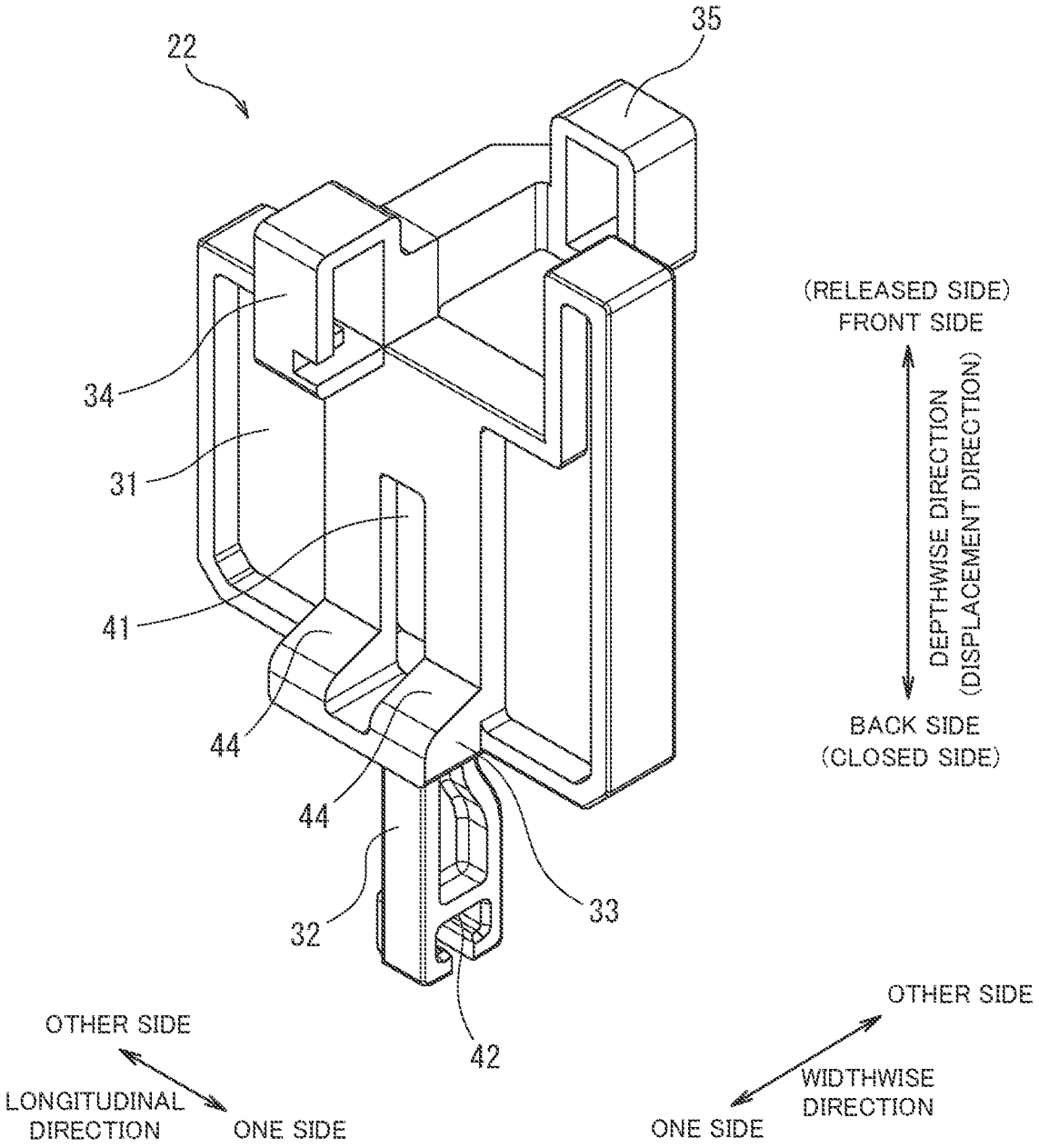
FIG. 2 is a diagram illustrating a latch support.

FIG. 2 is a diagram illustrating the latch support 22.

The latch support 22 includes a base body 31, a leg portion 32, a protrusion 33, a b contact portion 34, and an a contact portion 35.

The base body 31 has a substantially plate shape along the displacement direction and the longitudinal direction. At substantially a center thereof in the longitudinal direction is formed a through hole 41 extending along the displacement direction and penetrating in the widthwise direction.

The leg portion 32 is provided on the closed side of the base body 31 and extends along the closed side. The leg portion 32 is formed with a recessed groove 42 formed along the longitudinal direction at an end thereof on the closed side. The recessed groove 42 has a portion on the released side extending to both sides in the widthwise direction and is formed into a substantially T shape as viewed from the longitudinal direction. When the recessed groove 42 is fitted into the contact support 14 of the electromagnetic contactor 11 along the longitudinal direction (see FIG. 1), the latch support 22 is displaceable between the released side and the closed side in conjunction with the contact support 14.

The protrusion 33 is formed on one side of the base body 31 in the widthwise direction and at a portion of the through hole 41 on the closed side. The protrusion 33 protrudes on the one side in the widthwise direction and includes a latch surface 44 facing the released side. The portion of the through hole 41 on the closed side reaches the protrusion 33, and a part of the latch surface 44 is formed to be recessed toward the closed side. The latch surface 44 is inclined in such a manner as to go from the closed side to the released side from the rotating member 24 side toward the latch support 22 side. The inclination of the latch surface 44 is at an angle of, for example, around 20 degrees with respect to a plane along the longitudinal and widthwise directions. Preferably, the protrusion 33 has a tip chamfered so as to prevent burrs.

The b contact portion 34 has a substantially square cylindrical shape penetrating in the longitudinal direction, and is formed on the one side of the base body 31 in the widthwise direction and at a portion that is further on the released side than the through hole 41. The b contact portion 34 elastically supports an unillustrated movable contact element. The b contact portion 34 causes the movable contact element to contact with an unillustrated fixed contact element when the latch support 22 is on the released side, and separates the movable contact element from the fixed contact element when the latch support 22 is on the closed side.

The a contact portion 35 has a substantially square cylindrical shape penetrating in the widthwise direction, and is formed on an other side of the base body 31 in the widthwise direction and at a portion that is further on the released side than the through hole 41. The a contact portion 35 elastically supports an unillustrated movable contact element. The a-contact portion 35 separates the movable contact element from an unillustrated fixed contact element when the latch support 22 is on the released side, and causes the movable contact element to contact with the fixed contact element when the latch support 22 is on the closed side.

Figure 3A:
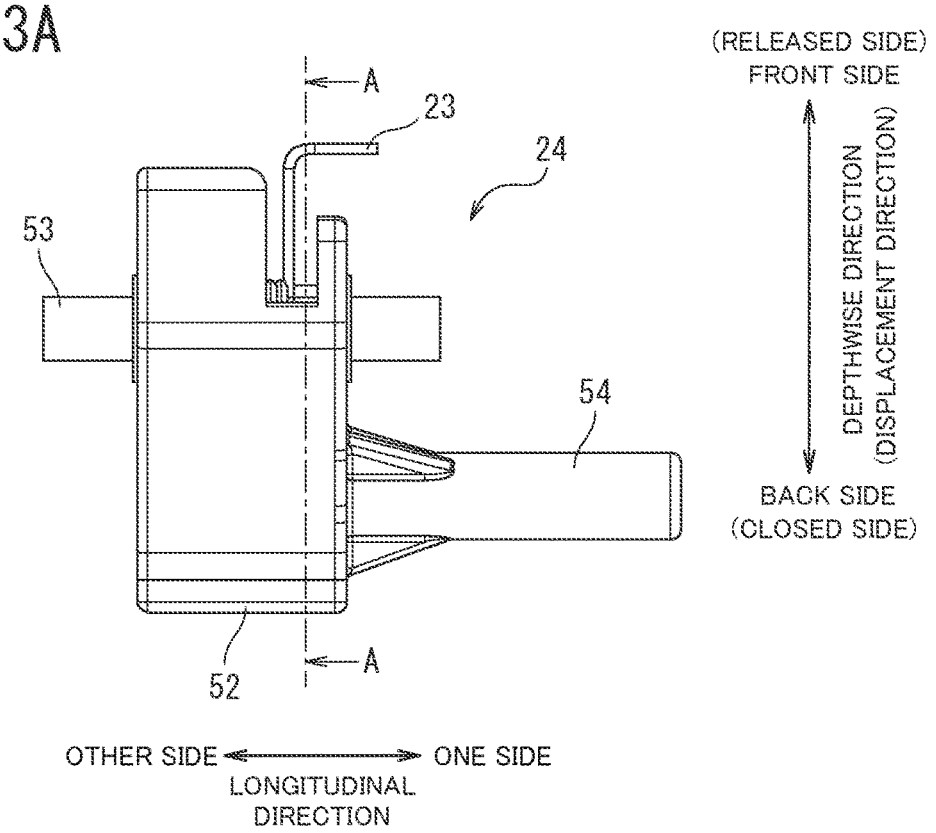
FIGS. 3A and 3B are diagrams illustrating a rotating member.
Figure 3B:
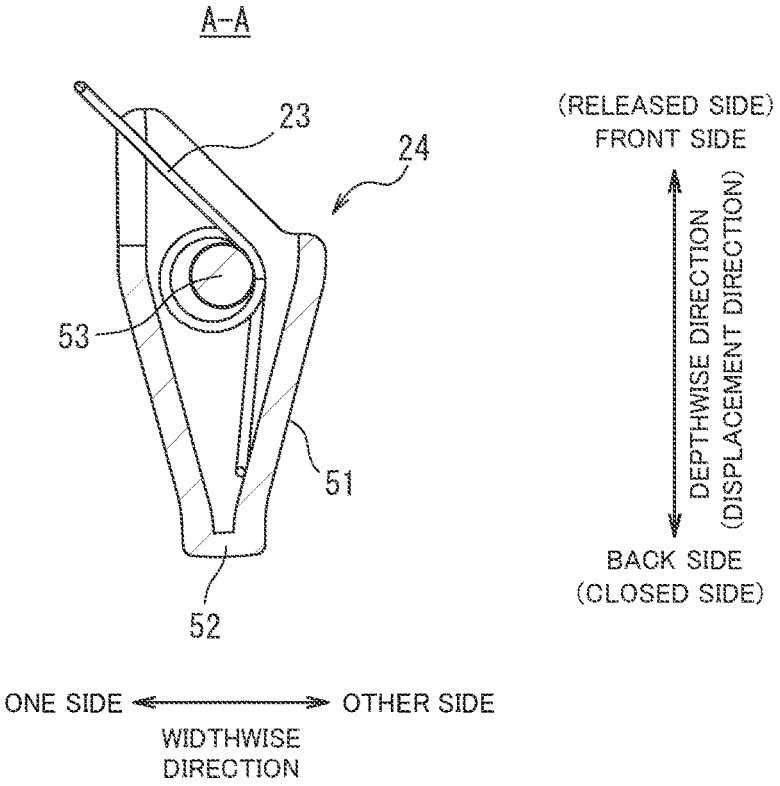

FIGS. 3A and 3B are diagrams illustrating the rotating member 24.

FIG. 3A is a diagram of the rotating member 24 as viewed from outside in the longitudinal direction, and FIG. 3B is a cross sectional diagram thereof taken along line A-A as viewed from one side in the widthwise direction. The rotating member 24 is larger than the through hole 41 of the latch support 22 in the longitudinal direction. Additionally, the rotating member 24 has a hollow inside, and a portion of the rotating member 24 on a front side in the depthwise direction widened in the widthwise direction is open, whereas a portion thereof on a back side in the depthwise direction narrowed in the widthwise direction is closed, thereby forming a substantially V-shaped cross section along the widthwise and depthwise directions as viewed from the longitudinal direction. The portion of the rotating member 24 on the back side in the depthwise direction is formed with an outer peripheral surface 51 facing the protrusion 33 of the latch support 22 and a substantially flat tip surface 52 facing the back side in the depthwise direction. The portion of the rotating member 24 on the front side in the depthwise direction includes a cylindrical support shaft 53 along the longitudinal direction being inserted through the portion, and the rotating member 24 is supported on the case 21 in a rotatable manner by the support shaft 53. Inside the rotating member 24, the support shaft 53 is inserted through the torsion spring 23. One end side of the torsion spring 23 is in contact with an inner peripheral surface of the case 21, and an other end side thereof is in contact with an inner peripheral surface of the rotating member 24, thereby biasing the portion of the rotating member 24 on the back side in the depthwise direction toward the protrusion 33 (see FIG. 1).

On the outer peripheral surface 51 of the rotating member 24 is formed a cylindrical manual operation portion 54 protruding on one side in the longitudinal direction.

Figure 4:
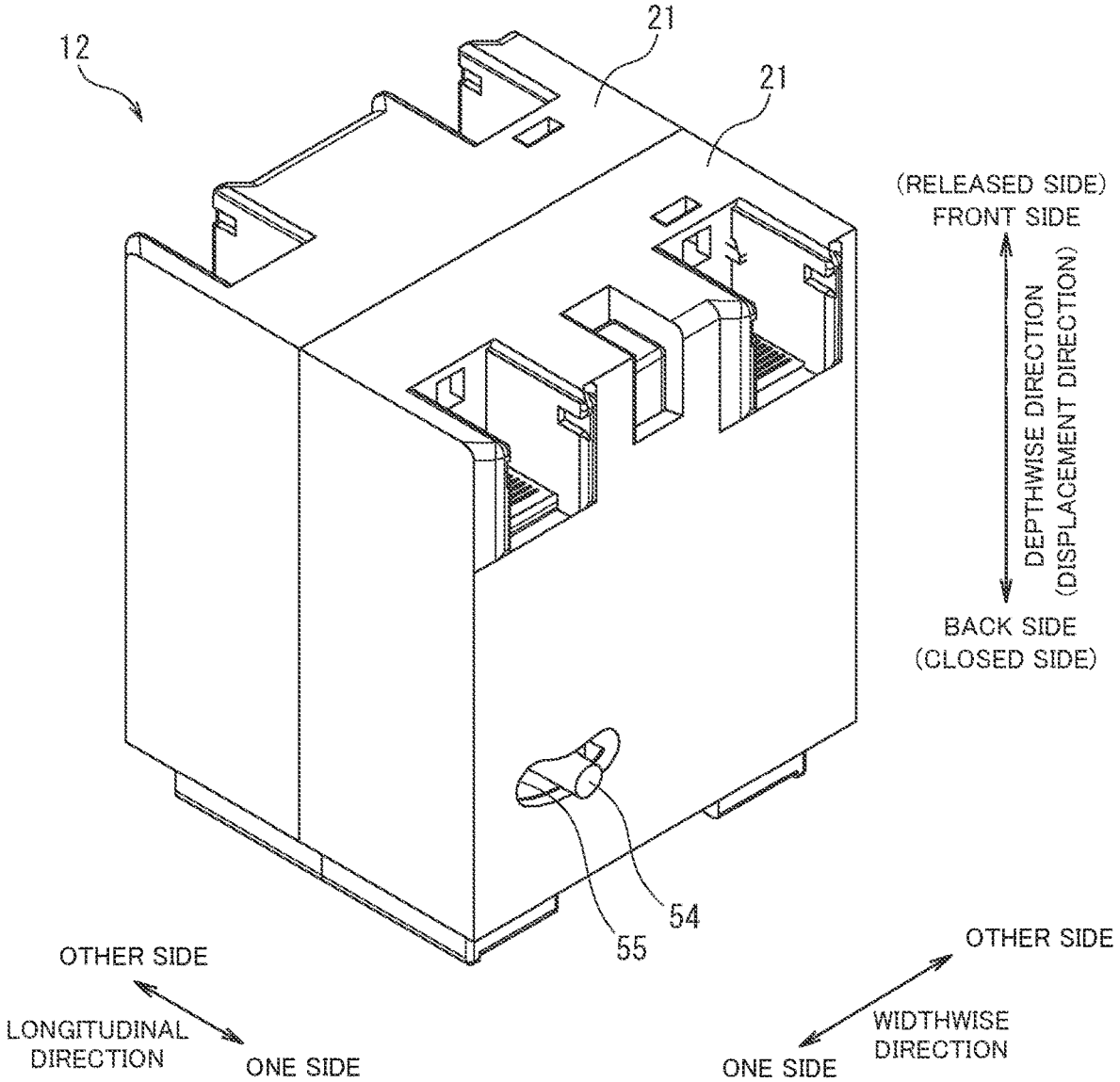
FIG. 4 is a diagram illustrating an external appearance of a mechanical latching device 12.

FIG. 4 illustrates an external appearance of the mechanical latching device 12.

One side surface of the case 21 in the longitudinal direction is formed with a long hole 55 that exposes the manual operation portion 54. The manual operation portion 54 is set to be long enough to stick out slightly from the side surface of the case 21. The long hole 55 extends in an arc shape along a trajectory of the manual operation portion 54 when the rotating member 24 rotates.

As illustrated in FIG. 1, the electromagnet 25 is arranged on the other side in the widthwise direction of the latch support 22 inside the case 21. Here, the electromagnet 25 is virtually indicated by a long dashed double-short dashed line, and a detailed description thereof is omitted, but includes a spool, a control coil, a yoke, and a return spring, all of which are not illustrated. Then, when the control coil is energized and excited, the plunger 26 is moved forward to the one side in the widthwise direction against an elastic force of the return spring. When the energization of the control coil is stopped to bring the control coil into an unexcited state, the return spring moves the plunger 26 backward to the other side in the widthwise direction.

The plunger 26 is a yoke inserted into the spool of the electromagnet 25, and is formed with a cylindrical protrusion rod 28 protruding on the one side in the widthwise direction. The protrusion rod 28 penetrates through the insertion hole 41 of the latch support 22 to the one side in the widthwise direction and has a hemispherical tip facing the rotating member 24.

Operation

Next is a description of a main operation of the first embodiment.

Figure 5A:
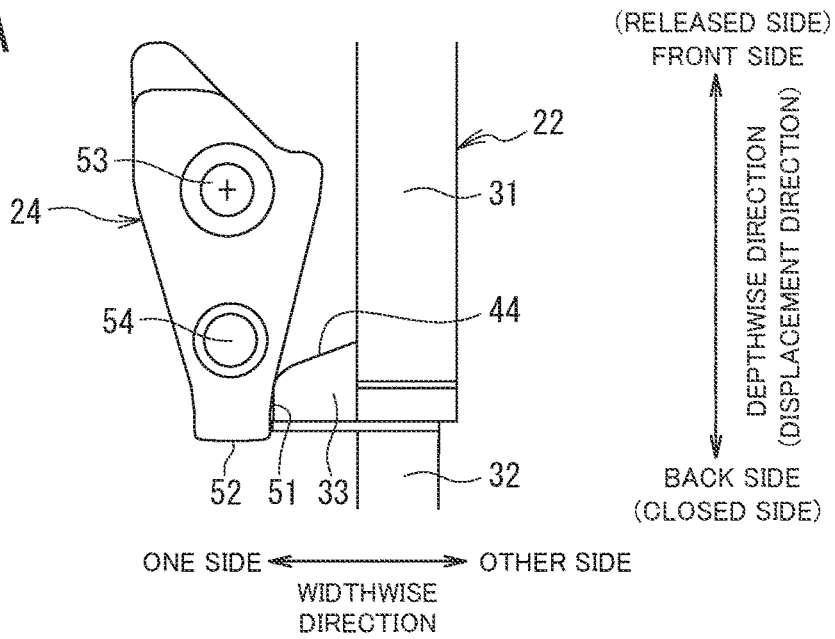
FIGS. 5A to 5C are diagrams illustrating an operation of the rotating member.
Figure 5B:
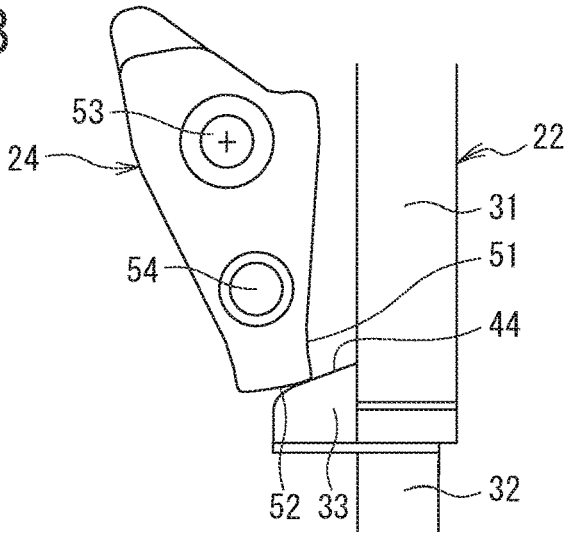
Figure 5C:
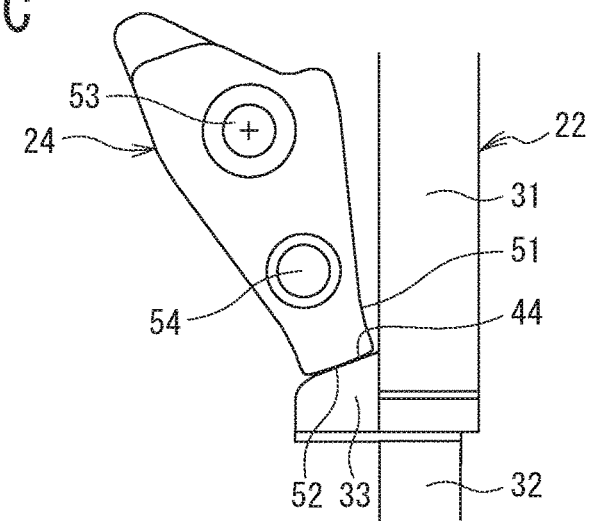

FIGS. 5A to 5C are diagrams illustrating an operation of the rotating member 24.

FIG. 5A illustrates a state where the rotating member 24 is in an initial position. Here, the latch support 22 is on the released side in conjunction with the contact support 14, and the outer peripheral surface 51 of the rotating member 24 is in contact with the tip of the protrusion 33 of the latch support 22. In other words, the rotating member 24 is in the initial position where the portion thereof on the back side in the depthwise direction is displaced to the one side in the widthwise direction against an elastic force of the torsion spring 23. In this case, the latch support 22 is allowed to be displaced to the closed side.

FIG. 5B illustrates a state where the rotating member 24 has rotated from the initial position. Here, the latch support 22 is on the closed side in conjunction with the contact support 14, and the rotating member 24 is rotated by the elastic force of the torsion spring 23, as a result of which the portion of the rotating member 24 on the back side in the depthwise direction is displaced to the other side in the widthwise direction. In this case, the tip surface 52 of the rotating member 24 contacts with the latch surface 44 of the protrusion 33 to mechanically prevent the latch support 22 from returning to the released side.

FIG. 5C illustrates a state where the rotating member 24 has further rotated from the initial position. Here, the latch support 22 is further on the closed side than in the state of FIG. 5B in conjunction with the contact support 14, and the rotating member 24 is rotated by the elastic force of the torsion spring 23, as a result of which the portion of the rotating member 24 on the back side in the depthwise direction is further displaced to the other side in the widthwise direction than in the state of FIG. 5B. In this case, the tip surface 52 of the rotating member 24 contacts with the latch surface 44 of the protrusion 33 to mechanically prevent the latch support 22 from returning to the released side.

Next, a description is given of how to cancel the latched state mechanically preventing the latch support 22 from returning to the released side. One way is to drive the plunger 26. Specifically, when the plunger 26 is moved forward to the one side in the widthwise direction by the electromagnet 25 in the closed state, the protrusion rod 28 pushes the rotating member 24 to displace the portion of the rotating member 24 on the back side in the depthwise direction to the one side in the widthwise direction. Another way is to manually operate the manual operation portion 54. Specifically, when a user operates the manual operation portion 54 of the rotating member 24 in the closed state, the portion of the rotating member 24 on the back side in the depthwise direction is displaced to the one side in the widthwise direction. In this way, returning the rotating member 24 to the initial position allows for cancellation of the latched state of the latch support 22.

Effects

Next, main effects of the first embodiment are described.

The amount of stroke of the contact support 14 varies depending on the model of the electromagnetic contactor 11, due to which the conventional structure has required the adjustment of the gap between the portions that mechanically prevents the returning of the latch support.

Thus, the mechanical latching device 12 of the electromagnetic contactor 11 according to the first embodiment includes the latch support 22 and the rotating member 24. The latch support 22 is connected to the contact support 14 of the electromagnetic contactor 11 and displaceable between the released side and the closed side. The latch support 22 includes the protrusion 33 protruding laterally and formed with the latch surface 44 facing the released side. One end side of the rotating member 24 is rotatably supported beside the latch support 22, and the other end side thereof is biased toward the protrusion 33. Additionally, when the latch support 22 is on the released side, the outer peripheral surface 51 on the other end side of the rotating member 24 contacts with the tip of the protrusion 33, allowing the latch support 22 to be displaced to the closed side. In addition, when the latch support 22 is on the closed side, the other end side of the rotating member 24 rotates according to the position of the latch support 22 in the displacement direction, and the tip surface 52 faces the latch surface 44, thereby mechanically preventing the latch support 22 from returning to the released side at the plurality of positions along the displacement direction. This eliminates the need for work on adjusting a gap between the portions that mechanically prevent the returning of the latch support 22, so that improved convenience can be achieved. Furthermore, the rotating member 24 is a single component, enabling suppression of increase in the number of components, and also facilitating assembly.

The latch surface 44 is inclined in such a manner as to go from the closed side to the released side from the rotating member 24 side toward the latch support 22 side. As a result, the tip surface 52 of the rotating member 24 faces the latch surface 44 according to the position of the latch support 22, thereby enabling the latch support 22 to be mechanically prevented from returning to the released side at the plurality of positions along the displacement direction. Moreover, any gap can be eliminated between the portions mechanically preventing the returning of the latch support 22. Accordingly, even when the control coil of the electromagnetic contactor 11 is not excited, the returning of the latch support 22 can be suppressed. In addition, in such a cam structure that the rotating member 24 is driven so as to follow a contour of the latch surface 44, the rotating member 24 can be operated smoothly without any sense of stepping since the latch surface 44 has no steps. Furthermore, the latch surface 44 of the protrusion 33 and the tip surface 52 of the rotating member 24 are not required to have high accuracy in dimensions, so that increased manufacturing cost can be suppressed.

The mechanical latching device 12 includes the plunger 26. The plunger 26 is driven by the electromagnet 25. When the plunger 26 moves forward from the latch support 22 side toward the outer peripheral surface 51 on the other end side of the rotating member 24, the tip of the plunger 26 pushes back the outer peripheral surface 51 on the other end side of the rotating member 24. This can easily cancel the latched state of the latch support 22.

The rotating member 24 includes the manual operation portion 54 that is rotatably operated by a user. Accordingly, when the manual operation portion 54 of the rotating member 24 is operated by the user, the portion thereof on the back side in the depthwise direction is pushed back. This allows for easy cancellation of the latched state of the latch support 22.

Next, a comparative example is described.

Figure 6A:
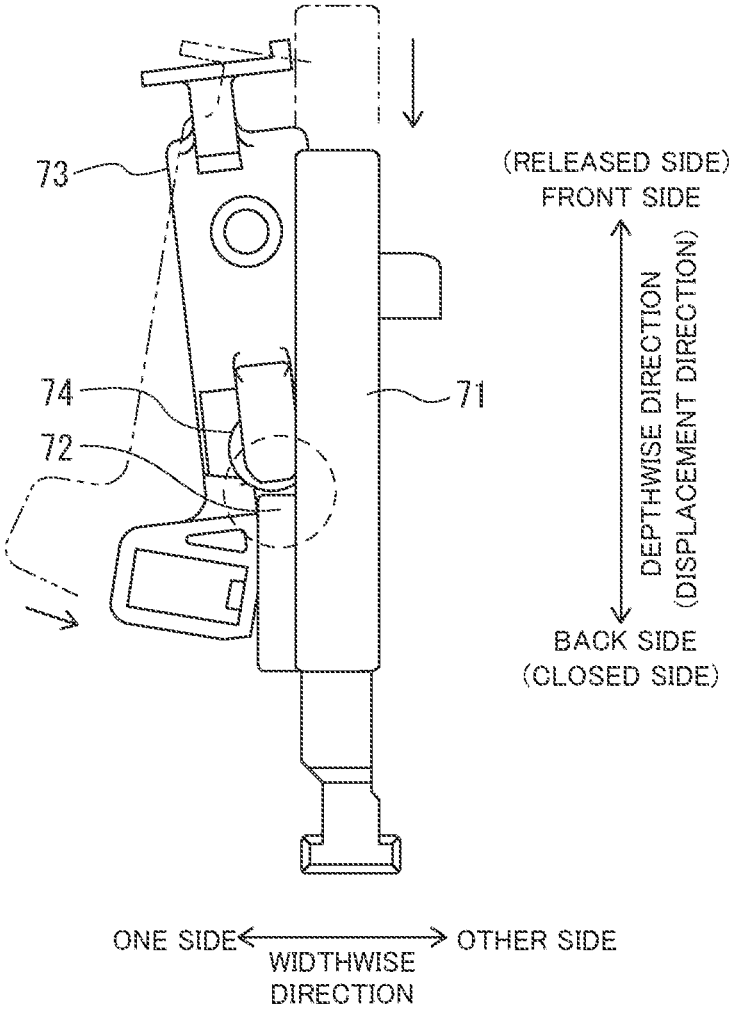
FIGS. 6A and 6B are diagrams illustrating a comparative example.
Figure 6B:
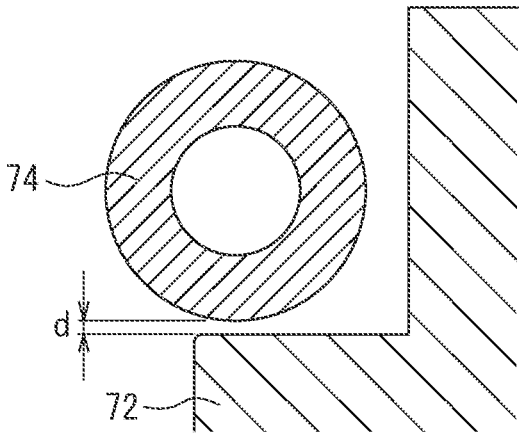

FIGS. 6A and 6B are diagrams illustrating the comparative example.

FIG. 6A is a diagram of the comparative example as viewed from one side in the longitudinal direction. In the drawing, a latch support 71 includes a shoulder portion 72, and a latch lever 73 includes a roller 74. In the comparative example, when the latch support 71 is displaced to the closed side, the roller 74 of the latch lever 73 is caught on the shoulder portion 72 of the latch support 71 to mechanically prevent the latch support 71 from returning to the released side. FIG. 6B is an enlarged diagram of the portions mechanically preventing the returning of the latch support 71. Excitation of the control coil of the electromagnetic contactor 11 provides a slight gap "d" (allowance) between the shoulder portion 72 and the roller 74. However, the amount of stroke of the contact support 14 varies depending on the model of the electromagnetic contactor 11, due to which the gap "d" also varies in size. When the control coil of the electromagnetic contactor 11 goes into an unexcited state, the latch support 71 returns by the size of the gap "d". Therefore, depending on the size of the gap "d", there is a need for work on adjusting the gap "d", such as replacement with the roller 74 that has a different outer diameter.

Second Embodiment

Configuration

The second embodiment has the same configuration as the first embodiment described above, except that the portions that mechanically prevent the returning of the latch support 22 are changed in structure. Therefore, the common components are denoted by the same reference signs, and a detailed description thereof is omitted.

Figure 7A:
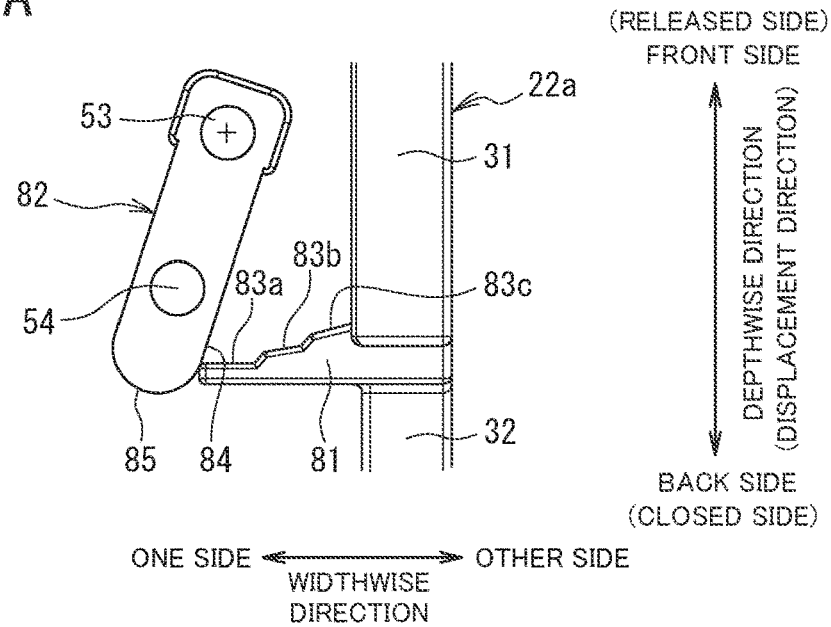
FIGS. 7A to 7C are diagrams illustrating an operation of a rotating member.
Figure 7B:
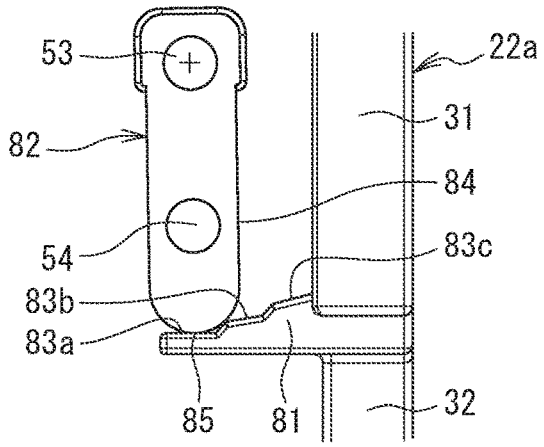
Figure 7C:
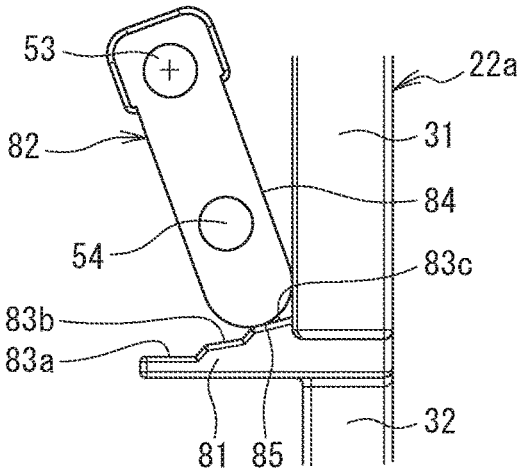

FIGS. 7A to 7C are diagrams illustrating an operation of the rotating member 82.

Here, the latch support 22, the protrusion 33, and the rotating member 24 described above are newly changed to a latch support 22*a*, a protrusion 81, and a rotating member 82.

Latch surfaces 83*a* to 83*c* of the protrusion 81 are formed into a stepped shape in such a manner as to go from the closed side to the released side from the rotating member 82 side toward the latch support 22*a* side. Here, the positions of the latch surfaces 83*a* to 83*c* in the displacement direction are set to go up to the released side in an order of the latch surface 83*a*, the latch surface 83*b*, and the latch surface 83*c* from one side toward the other side in the widthwise direction. The latch surface 83*a* is a plane along the longitudinal and widthwise directions, whereas the latch surfaces 83*b* and 83*c* are slightly inclined in such a manner as to go from the closed side to the released side from the rotating member 82 side toward the latch support 22*a* side. Each step has the same height, which is, for example, approximately 0.5 mm.

The rotating member 82 extends in the depthwise direction. A portion of the rotating member 82 on the back side in the depthwise direction is formed with an outer peripheral surface 84 facing the protrusion 81 of the latch support 22*a* and a tip surface 85 having a semicircular shape as viewed from the longitudinal direction and facing the back side in the depthwise direction. Note that as in the first embodiment described above, the rotating member 82 is rotatably supported by the support shaft 53, the cylindrical manual operation portion 54 is formed, and the portion of the rotating member 82 on the back side in the depthwise direction is biased by the torsion spring 23 toward the protrusion 81.

Operation

Next, a main operation of the second embodiment is described.

FIG. 7A illustrates a state where the rotating member 82 is in an initial position. Here, the latch support 22*a* is on the released side in conjunction with the contact support 14, and the outer peripheral surface 84 of the rotating member 82 is in contact with the tip of the protrusion 81 of the latch support 22*a*. In other words, the rotating member 82 is in the initial position where the portion thereof on the back side in the depthwise direction is displaced to one side in the widthwise direction against the elastic force of the torsion spring 23. In this case, the latch support 22*a* is allowed to be displaced to the closed side.

FIG. 7B illustrates a state where the rotating member 82 has rotated from the initial position. Here, the latch support 22*a* is on the closed side in conjunction with the contact support 14, and the rotating member 82 is rotated by the elastic force of the torsion spring 23, as a result of which the portion of the rotating member 82 on the back side in the depthwise direction is displaced to the other side in the widthwise direction. In this case, the tip surface 85 of the rotating member 82 contacts with the latch surface 83*a* of a first step of the protrusion 81 to mechanically prevent the latch support 22*a* from returning to the released side.

FIG. 7C illustrates a state where the rotating member 82 has further rotated from the initial position. Here, the latch support 22*a* is further on the closed side than in the state of FIG. 7B in conjunction with the contact support 14, and the rotating member 82 is rotated by the elastic force of the torsion spring 23, as a result of which the portion of the rotating member 82 on the back side in the depthwise direction is further displaced to the other side in the widthwise direction than in the state of FIG. 7B. In this case, the tip surface 85 of the rotating member 82 contacts with the latch surface 83*c* of a third step of the protrusion 81 to mechanically prevent the latch support 22*a* from returning to the released side.

Other operations are the same as those of the first embodiment described above.

Effects

Next, main effects of the second embodiment are described.

The mechanical latching device 12 of the electromagnetic contactor 11 according to the second embodiment includes the latch support 22*a* and the rotating member 82. The latch support 22*a* is connected to the contact support 14 of the electromagnetic contactor 11 and displaceable between the released side and the closed side. The latch support 22*a* includes the protrusion 81 protruding laterally and formed with the latch surfaces 83*a* to 83*c* facing the released side. One end side of the rotating member 82 is rotatably supported beside the latch support 22*a*, and the other end side thereof is biased toward the protrusion 81. Additionally, when the latch support 22*a* is on the released side, the outer peripheral surface 84 on the other end side of the rotating member 82 contacts with the tip of the protrusion 81, allowing the latch support 22*a* to be displaced to the closed side. In addition, when the latch support 22*a* is on the closed side, the other end side of the rotating member 82 rotates according to the position of the latch support 22*a* in the displacement direction, and the tip surface 85 faces the latch surfaces 83*a* to 83*c*, thereby mechanically preventing the latch support 22*a* from returning to the released side at the plurality of positions along the displacement direction. This eliminates the need for work on adjusting the gap between the portions mechanically preventing the returning of the latch support 22*a*, so that improved convenience can be achieved. Furthermore, the rotating member 82 is a single component, enabling suppression of increase in the number of components, and also facilitating assembly.

The latch surfaces 83*a* to 83*c* are formed into the stepped shape in such a manner as to go from the closed side to the released side from the rotating member 82 side toward the latch support 22*a* side. As a result, the tip surface 85 of the rotating member 82 faces any one of the latch surfaces 83*a* to 83*c* according to the position of the latch support 22*a*, thereby enabling the latch support 22*a* to be mechanically prevented from returning to the released side at the plurality of positions along the displacement direction. Additionally, in such a cam structure that the rotating member 82 is driven so as to follow the contours of the latch surfaces 83*a* to 83*c*, the rotating member 82 can be operated with a sense of moderation since the latch surfaces 83*a* to 83*c* are formed into the stepped shape.

Other effects are the same as those of the first embodiment described above.

Modifications

The second embodiment has been described using the configuration mechanically preventing the latch support 22*a* from returning to the released side at the three positions along the displacement direction. However, the present invention is not limited thereto. Thus, by changing the quantity of the latch surfaces, the latch support 22*a* may be mechanically prevented from returning to the released side at two positions or four or more positions along the displacement direction.

While the present invention has been described with reference to the limited number of embodiments, the scope of the rights of the invention is not limited thereto. It will be obvious to those skilled in the art that various changes and modifications may be made in the embodiments based on the above disclosure.

REFERENCE SIGNS LIST

11: Electromagnetic contactor
12: Mechanical latching device
13: Opening portion
14: Contact support
21: Case
22: Latch support
23: Torsion spring
24: Rotating member
25: Electromagnet
26: Plunger
28: Protrusion rod
31: Base body
32: Leg portion
33: Protrusion
34: b contact portion
35: a contact portion
41: Through hole
42: Recessed groove
44: Latch surface
51: Outer peripheral surface
52: Tip surface
53: Support shaft
54: Manual operation portion
55: Long hole
71: Latch support
72: Shoulder portion
73: Latch lever
74: Roller
22*a*: Latch support
81: Protrusion
82: Rotating member
83*a*: Latch surface
83*b*: Latch surface
83*c*: Latch surface
84: Outer peripheral surface
85: Tip surface
d: Gap

The invention claimed is:

1. A mechanical latching device of an electromagnetic contactor, the mechanical latching device comprising:

a latch support connected to a contact support of the electromagnetic contactor and displaceable between a released side and a closed side, the latch support including a protrusion protruding laterally and formed with a latch surface facing the released side; and a rotating member having an end side rotatably supported beside the latch support and an other end side biased toward the protrusion, wherein when the latch support is on the released side, an outer peripheral surface of the other end side of the rotating member is in contact with a tip of the protrusion to allow the latch support to be displaced to the closed side, and when the latch support is displaced to the closed side, the other end side of the rotating member is rotatable according to a position of the latch support in a displacement direction, from among a plurality of positions along the displacement direction, and a tip surface of the other end side of the rotating member faces the latch surface to mechanically prevent the latch support from returning to the released side.

2. The mechanical latching device of an electromagnetic contactor according to claim 1, wherein the latch surface is inclined in such a manner as to go from the closed side to the released side from the rotating member side toward the latch support side.

3. The mechanical latching device of an electromagnetic contactor according to claim 1, wherein the latch surface is formed into a stepped shape in such a manner as to go from the closed side to the released side from the rotating member side toward the latch support side.

4. The mechanical latching device of an electromagnetic contactor according to claim 1, further comprising a plunger configured to be driven by an electromagnet, the plunger pushing back the outer peripheral surface of the other end side of the rotating member at a tip of the plunger when moving forward from the latch support side toward the outer peripheral surface of the other end side of the rotating member.

5. The mechanical latching device of an electromagnetic contactor according to claim 1, wherein the rotating member includes a manual operation portion configured to manually rotate the rotating member.

6. The mechanical latching device of an electromagnetic contactor according to claim 2, further comprising a plunger configured to be driven by an electromagnet, the plunger pushing back the outer peripheral surface of the other end side of the rotating member at a tip of the plunger when moving forward from the latch support side toward the outer peripheral surface of the other end side of the rotating member.

7. The mechanical latching device of an electromagnetic contactor according to claim 3, further comprising a plunger configured to be driven by an electromagnet, the plunger pushing back the outer peripheral surface of the other end side of the rotating member at a tip of the plunger when moving forward from the latch support side toward the outer peripheral surface of the other end side of the rotating member.

8. The mechanical latching device of an electromagnetic contactor according to claim 2, wherein the rotating member includes a manual operation portion configured to manually rotate the rotating member.

9. The mechanical latching device of an electromagnetic contactor according to claim 3, wherein the rotating member includes a manual operation portion configured to manually rotate the rotating member.

10. The mechanical latching device of an electromagnetic contactor according to claim 4, wherein the rotating member includes a manual operation portion configured to manually rotate the rotating member.

11. The mechanical latching device of an electromagnetic contactor according to claim 6, wherein the rotating member includes a manual operation portion configured to manually rotate the rotating member.

12. The mechanical latching device of an electromagnetic contactor according to claim 7, wherein the rotating member includes a manual operation portion configured to manually rotate the rotating member.

* * * * *